US011377829B2

(12) United States Patent
Li et al.

(10) Patent No.: US 11,377,829 B2
(45) Date of Patent: Jul. 5, 2022

(54) ROUGH-IN ASSEMBLY FOR FREE-STANDING FAUCET

(71) Applicant: Globe Union Industrial Corp., Taichung (TW)

(72) Inventors: Chunhung Li, Taichung (TW); Chaoyen Hsu, Taichung (TW); Kuotung Ni, Taichung (TW); Yiping Lin, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 183 days.

(21) Appl. No.: 16/939,394

(22) Filed: Jul. 27, 2020

(65) Prior Publication Data

US 2020/0354931 A1 Nov. 12, 2020

(51) Int. Cl.
*E03C 1/04* (2006.01)
*E03C 1/02* (2006.01)

(52) U.S. Cl.
CPC ..... *E03C 1/0403* (2013.01); *E03C 1/023* (2013.01)

(58) Field of Classification Search
CPC ..... E03C 1/0403; E03C 1/04; E03C 1/023; E03C 1/021
USPC ..... 4/695
See application file for complete search history.

(56) References Cited

U.S. PATENT DOCUMENTS 9,334,633 B2 5/2016 Harris et al.
2009/0172878 A1* 7/2009 Shieh ..... E03C 1/0401 285/204
2020/0141096 A1* 5/2020 Hsieh ..... E03C 1/0403
2020/0217052 A1* 7/2020 Li ..... E03C 1/0403

FOREIGN PATENT DOCUMENTS

CN 110042886 A 7/2019

* cited by examiner

*Primary Examiner* — Huyen D Le
(74) *Attorney, Agent, or Firm* — Alan D. Kamrath; Karin L. Williams; Mayer & Williams PC

(57) ABSTRACT

A rough-in assembly for free-standing faucets is revealed. The rough-in assembly having at least a part thereof fixed under a floor includes a base, a first water-contact member and a second water-contact member separated from each other and disposed on the base, and a sleeve mounting seat connected to the base and provided with a top plate portion extending across the first and second water-contact members. Two first hollow-out holes are arranged at the top plate portion and corresponding to control valve sets of the water-contact members respectively. The top plate portion is also for installation and positioning of the free-standing faucet. The position and the direction of least one of the water-contact members can be adjusted so that the rough-in assembly is adapted to use in different water supply pipe arrangements. The disposition of the sleeve mounting seat ensures stability and aesthetics of the free-standing faucet.

22 Claims, 13 Drawing Sheets

ROUGH-IN ASSEMBLY FOR FREE-STANDING FAUCET

BACKGROUND OF THE INVENTION

Field of the Invention

The present invention relates to a rough-in assembly, especially to a rough-in assembly able to be mounted under a floor and used for mounting a free-standing faucet.

Description of Related Art

A typical free-standing faucet is disposed on a floor around a tub for filling water into the tab. Refer to U.S. Pat. No. 9,334,633, a tub filler faucet assembly for coupling to a floor is revealed. The tub filler faucet assembly includes a free-standing spout spaced apart from a tub wall; a valve assembly fluidly coupled to the spout; a free-standing mounting assembly spaced apart from the tub wall and coupled to the spout and a top surface of the floor; and a rough-in assembly positioned below the floor and coupled to the free-standing mounting assembly. The rough-in assembly includes at least one passageway fluidly coupled to the valve assembly.

The rough-in assembly further includes a cold-water inlet tube, a hot-water inlet tube, a base and a cover that conceals the inlet tubes and a portion of the base. At least a part of the rough-in assembly is positioned below the floor while other portions of the rough-in assembly are protruding from the floor.

After reviewing technical documents, the rough-in assembly generally includes a single base or two bases. The single base has two water supply ports connected to a cold-water supply pipe and a hot-water supply pipe correspondingly. If there are two bases in the rough-in assembly, each of the bases is provided with a water supply port while the water supply port of one of the bases is connected to the cold-water supply pipe and the water supply port of the other base is connected to the hot-water supply pipe. A first alignment plate and a second alignment plate are disposed between the two bases to keep a preset distance between the two bases. However, no matter single-base or double-base, the base is usually made from metals such as copper-based metals so that the bases produced have the shortcoming of too much weight.

Moreover, the water supply port is located at a specific position of the single base. Yet the water supply pipes for cold water and hot water can be arranged in a variety of ways. For example, the hot-water ad cold-water supply pipes are in line with or perpendicular to each other. Sometimes the water supply pipes for cold water and hot water may be disposed on weird positions with specific angles between them due to limitations caused by the surrounding environment or space. Now the base with the water supply port at the specific position doesn't meet the requirement of the pipe arrangement. As to the rough-in assembly with two bases, it is mainly adapted for use in the design with two trim members, not suitable for the design with single trim member. The respective trim members are designed to be disposed on certain positions and having certain distances therebetween so that trim tubes mounted therein for connection to a cold water inlet tube and a hot water inlet tube respectively also need to be arranged at certain positions with certain distances therebetween. Thereby the above rough-in assembly with two bases is only applied to one kind of water supply pipe arrangement, without being widely used in different water supply pipe arrangements.

Furthermore, the above base is connected to the bottom surface of the floor by fasteners. But such connection may cause irreparable damages to the floor. The above free-standing mounting assembly includes at least one trim member and a mounting plate connected to the trim member. The mounting plate is connected to cylindrical openings of the base by fasteners for clamping and positioning the floor firmly. That is to say, the floor is clamped and pressed by both the mounting plate and the base. At the same, the total weight of the filler faucet assembly composed of the base and the free-standing mounting assembly acts on the floor. The rough-in assembly with such design has at least two problems. The first one is that under certain conditions, installers are easy to over-tighten the fasteners in order to connect the base and free-standing mounting assembly firmly. A certain area of the floor being clamped is unable to take the load and thus getting damaged to have dents and deformation therearound. Or the structural strength of the floor is low and thus easy to have dents and deformation. The second problem is that the floor itself can't stand the weight of the filler faucet assembly even the fasteners are properly torqued. The dents and deformation still show.

Refer to Chinese Patent. Pub. No. CN110042886A, a mounting base for floor bathtub faucets is revealed. The mounting base has similar problems. For example, two water inlets arranged at a base of the mounting base are designed to have certain positions and directions. Thus the mounting base is only adapted for use in one kind of water supply pipe arrangement. A positioning member is formed by the bottom of an outer part and a positioning flange which allows the positioning member to insert in is formed on the base. There is only the positioning mechanism provided, without disclosing any fastening mechanism. Thereby whether the outer part is firmly secured on the base of the mounting base is uncertain.

SUMMARY OF THE INVENTION

Therefore it is a primary objet of the present invention to provide a rough-in assembly for free-standing faucets able to be widely applied to different water supply pipe arrangements for reducing cost for mold making and material preparation and improving ease of installation.

It is another object of the present invention to provide a rough-in assembly for free-standing faucets, which ensures the stability and aesthetics of the free-standing faucet after installation, without being affected by structural strength of the floor.

In order to achieve the above objects, a rough-in assembly for free-standing faucets having at least a part thereof being fixed under a floor according to the present invention includes a base, a first water-contact member, a second water-contact member, and a sleeve mounting seat. The base is connected under the floor.

The first water-contact member is connected to a top surface of the base and composed of a first water inlet, a first water outlet, a first water passage formed between the first water inlet and the first water outlet, and a first control valve set disposed on the first water passage for control of a water flow passed through the first water passage.

The second water-contact member which is connected to the top surface of the base includes a second water inlet, a second water outlet, a second water passage formed between the second water inlet and the second water outlet, and a second control valve set disposed on the second water passage for control of a water flow passed through the second water passage.

The sleeve mounting seat is connected to the top surface of the base and provided with a top plate portion which is extending across the first water-contact member and second water-contact member. Two first hollow-out holes are arranged at the top plate portion and corresponding to the first control valve set and the second control valve set respectively.

Preferably, the base is fastened on a connecting wall by a plurality of fasteners inserted through the base.

Preferably, the connecting wall is formed by a support board which is fixed on a basic object.

Preferably, the basic object includes two vertical plates while two ends of the support board are fixed on opposite surfaces of the vertical plates correspondingly. The vertical plates are disposed on a floor surface.

Preferably, the floor includes a surface plate and a pad connected to a bottom surface of the surface plate. The bottom surface of the pad is supported by the top surfaces of the vertical plates.

Preferably, the rough-in assembly for free-standing faucets further includes a first connection pipe and a second connection pipe. The first connection pipe has a first inlet end and a first outlet end. The first inlet end is connected to the first water outlet of the first water-contact member for guiding a water flow from the first water-contact member to a first flow pipe of the free-standing faucet through the first outlet end. The second connection pipe includes a second inlet end and a second outlet end. The second inlet end is connected to the second water outlet of the second water-contact member for guiding a water flow from the second water-contact member to a second flow pipe of the free-standing faucet through the second outlet end.

Preferably, the top plate portion is further provided with two second hollow-out holes through which the first connection pipe and the second connection pipe respectively are passed.

Preferably, a mounting hole that goes through the floor vertically is provided and at least the top plate portion of the sleeve mounting seat is mounted in the mounting hole. The first connection pipe and the second connection pipe are inserted through and extending out above the mounting hole.

Preferably, the top plate portion 61 of the sleeve mounting seat is further provided with a plurality of threaded holes. The free-standing faucet includes a free-standing sleeve, a decorative cover, a fixing baseplate, and a plurality of first bolts. A chamber is formed in the free-standing sleeve for mounting the first flow pipe and the second flow pipe therein while the first connection pipe and the second connection pipe are inserted through an opening on the bottom of the free-standing sleeve and mounted into the chamber. The decorative cover is slidably mounted to an outer peripheral wall of the free-standing sleeve for covering the mounting hole of the floor. The fixing baseplate is connected to and fixed on an outer peripheral wall of the bottom of the free-standing sleeve and provided with a plurality of first insertion holes and two valve-set holes. The fixing baseplate is connected to the top plate portion of the sleeve mounting seat by the respective first bolts being inserted through the respective first insertion holes and screwed into the respective first threaded holes.

Preferably, the free-standing faucet further includes a sealing plate and two second bolts. The sealing plate is slidably mounted to the outer peripheral wall of the free-standing sleeve for covering the mounting hole of the floor. The sealing plate is covered with the decorative cover and provided with two second insertion holes while the fixing baseplate is provided with two second threaded holes. Thereby the sealing plate is abutting against and sealing the top surface of the floor by the respective second bolts being inserted through the respective second insertion holes and screwed into the respective second threaded holes.

Preferably, there is an angle formed between the first central axis in the opening direction of the first water inlet of the first water-contact member and the second central axis in the opening direction of the second water inlet of the second water-contact member. The angle is 180 degrees.

Preferably, the sleeve mounting seat is C-shaped and composed of two side plate portions integrally extending from two opposites sides of the top plate portion and two connecting plate portions integrally extending from the respective side plate portions and used for connection with the top surface of the base. A mounting space is defined by the top plate portion and the side plate portions. An opening is formed on each of two opposite sides of the mounting space so that the first water supply pipe is connected to the first water inlet of the first water-contact member through one of the openings and the second water supply pipe is connected to the second water inlet of the second water-contact member through the other opening.

Preferably, both the first water-contact member and the second water-contact member include two lugs each of which is provided with an insertion hole. The base is provided with four connecting holes which are divided into two sets. By two sets of two fasteners inserted through the respective insertion holes on the respective lugs and mounted in the respective sets of the connecting holes securely, the first water-contact member and the second water-contact member are connected to and fixed on the base.

Preferably, the rough-in assembly further includes two air caps used for being plugged into the first outlet end of the first connection pipe and the second outlet end of the second connection pipe respectively.

Preferably, the rough-in assembly further includes a protective cover whose bottom is well mounted in the mounting hole of the floor. Thereby the first connection pipe, the second connection pipe, the first control valve set of the first water-contact member and the second control valve set of the second water-contact member arranged relative to the mounting hole are covered with and protected by the protective cover.

Preferably, there is an angle formed between the first central axis in the opening direction of the first water inlet of the first water-contact member and the second central axis in the opening direction of the second water inlet of the second water-contact member. The angle is in the range of 90 degrees to 270 degrees.

Preferably, the first water-contact member is fixed on the base while the direction and position of the first water-contact member are unable to be adjusted. The second water-contact member whose direction and position are able to be adjusted is connected to the base so as to adjust and control the angle.

Preferably, the angle can be 90 degrees, 180 degrees or 270 degrees.

Preferably, the first water-contact member and the second water-contact member include two first lugs and two second lugs respectively. Each of the first lugs and each of the second lugs are provided with a first insertion hole and a second insertion hole respectively. The base is provided with two first connecting holes and at least six second connecting holes. Two of the second connecting holes form a set so that there are a first set, a second set, and a third set of the second connecting holes. The first water-contact member is fixed on the base by two fasteners being inserted through the first insertion holes on the first lugs and fastened in the first connecting holes. The second water-contact member is connected to the base by two fasteners being inserted through the second insertion holes on the second lugs and selectively locked in one of the three sets of the second connecting holes. The angle formed between the first and second water-contact members is 90 degrees, 180 degrees, and 270 degrees when the fasteners are connected to the first set, the second set and the third set of the second connecting holes respectively.

Preferably, the sleeve mounting seat is C-shaped and composed of two side plate portions integrally extending from two opposites sides of the top plate portion and two connecting plate portions integrally extending from the respective side plate portions and used for connection with the top surface of the base. A through hole is disposed on each of the side plate portions of the sleeve mounting seat. A mounting space is defined by the top plate portion and the side plate portions. An opening is formed on each of two opposite sides of the mounting space so that the first water supply pipe is connected to the first water inlet of the first water-contact member through one of the openings and the second water supply pipe is connected to the second water inlet of the second water-contact member through the other opening and one of the through holes. A first hollow-out hole on the top plate portion of the sleeve mounting seat and corresponding to the second control valve set is a curved slot so that the second control valve set can be kept within the curved slot when the angle between the first and second water-contact members is adjusted in the range of 90 degrees to 270 degrees.

Preferably, the centers of the second connecting holes are arranged at a circumference of an imaginary circle while the center of the imaginary circle is located at the central axis of the second water outlet of the second water-contact member.

The rough-in assembly includes two separate water-contact members, the second water-contact member and the second water-contact member. The position and the direction of at least one of the water-contact members can be adjusted according to actual arrangement of the water supply pipes. Thereby the rough-in assembly can be widely applied to the water supply pipes arranged with various angles therebetween. Therefore not only the cost for mold making and material preparation is reduced, the ease of installation is also enhanced.

The free-standing faucet can be installed and fixed directly by the disposition of the sleeve mounting seat. Compared with the conventional technique by which the free-standing faucet 1 is directly clamped and fastened on the floor, the problem of the floor that is easy to have dents or deformation can be solved. There are no worries about either damages of the floor or whether the structural strength of the floor with specific material and thickness is able to bear the clamping force or the total weight of the free-standing faucet and the rough-in assembly. The free-standing faucet is securely firmly, without being wobbly while being touched or contacted in use. Moreover, the overall look is more aesthetically pleasing.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

The preferred embodiments and figures of the present invention are described in detail as follows.

Refer to FIG. 1-6, an embodiment of a rough-in assembly 100 according to the present invention used for mounting a free-standing faucet 1 on a floor a, particularly the floor a around a tub is revealed. In this embodiment, the floor a includes a surface plate a1 and a pad a2 connected to a bottom surface of the surface plate a1. The surface plate a1 can be a common tile, a carpet, a piece of wood, a sheet made from various materials, etc. The free-standing faucet 1 is basically separated from the tub and water flows into the tub through the free-standing faucet 1.

Figure 8:
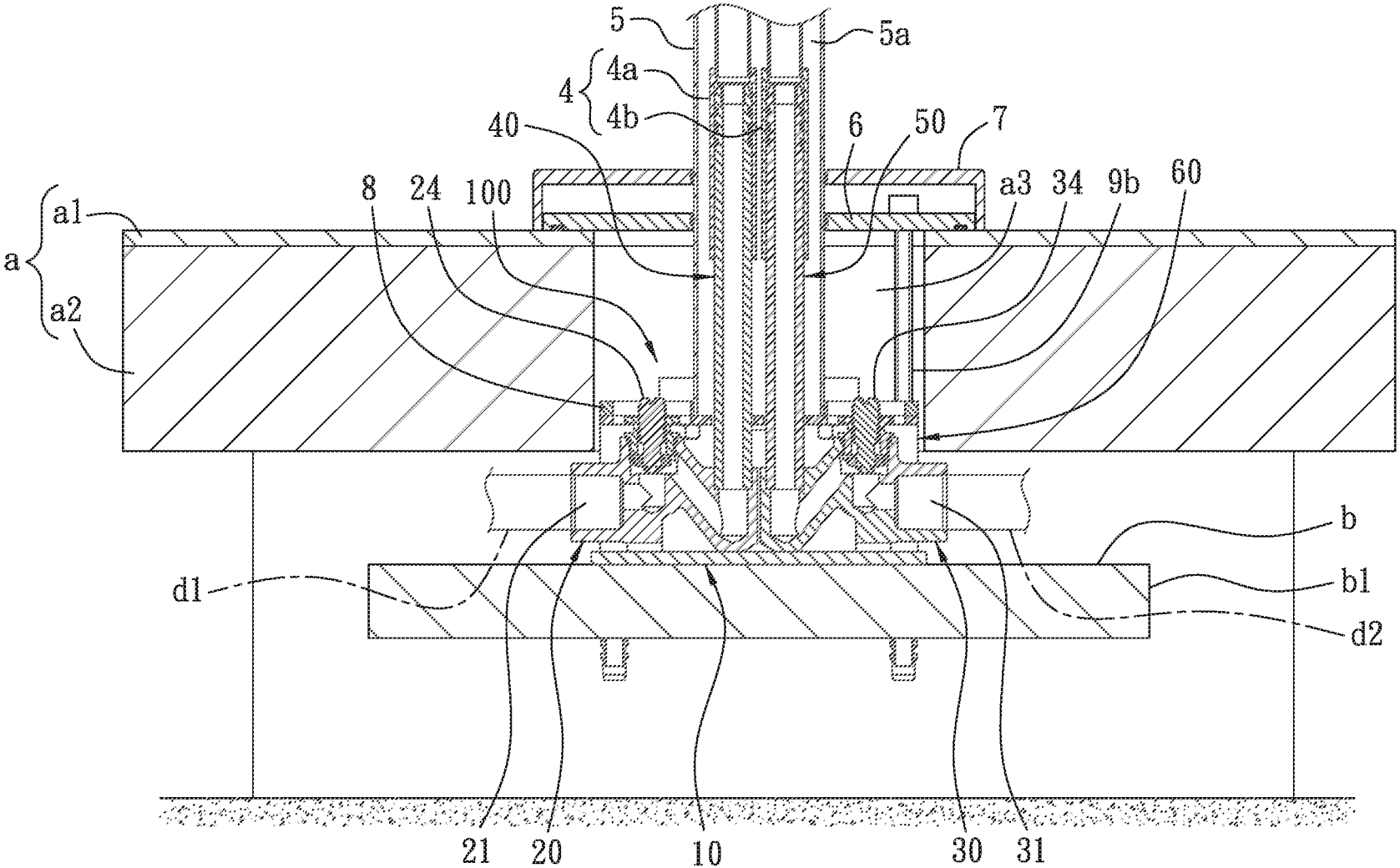
FIG. 8 is a side view of a partial longitudinal section of an embodiment assembled with a free-standing faucet according to the present invention.

To be more precisely, the free-standing faucet 1 generally includes a valve assembly 2, a spout 3 connected to the valve assembly 2, an inlet tube set 4 connected to the valve assembly 2, and a free-standing sleeve 5 connected to the valve assembly 2. As shown in FIG. 8, the inlet tube set 4 is mounted in a chamber 5*a* of the free-standing sleeve 5 and is composed of a first flow pipe 4*a* and a second flow pipe 4*b*. The first flow pipe 4*a* and the second flow pipe 4*b* come in pairs; one is used as a cold-water inlet tube and the other is used as a hot-water inlet tube. At least a part of the rough-in assembly 100 is fixed under the floor a. The rough-in assembly 100 consists of a base 10, a first water-contact member 20, a second water-contact member 30, a first connection pipe 40, a second connection pipe 50, and a sleeve mounting seat 60.

Figure 1:
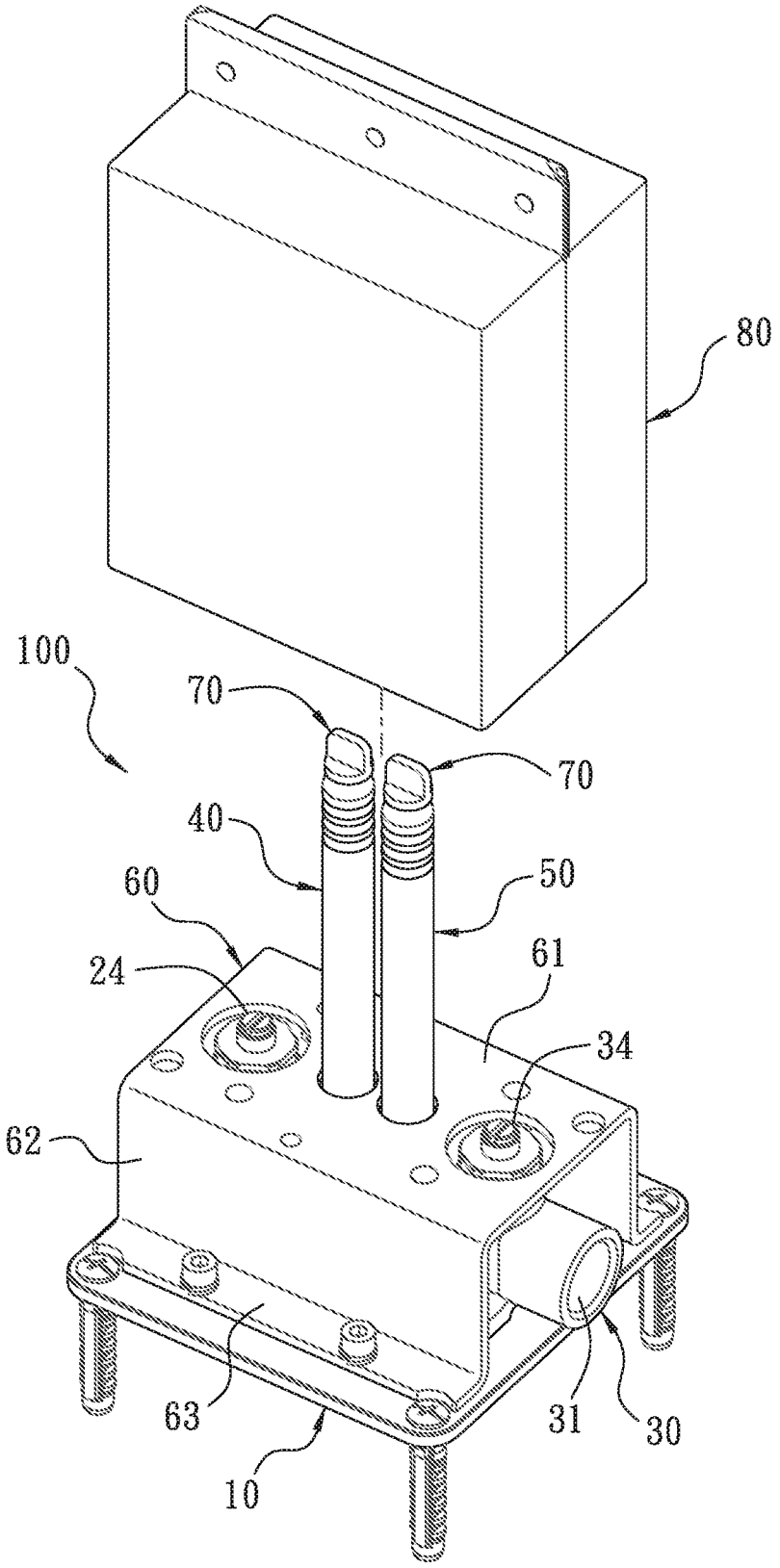
FIG. 1 is a perspective view of an embodiment with a separate protective cover according to the present invention.
Figure 2:
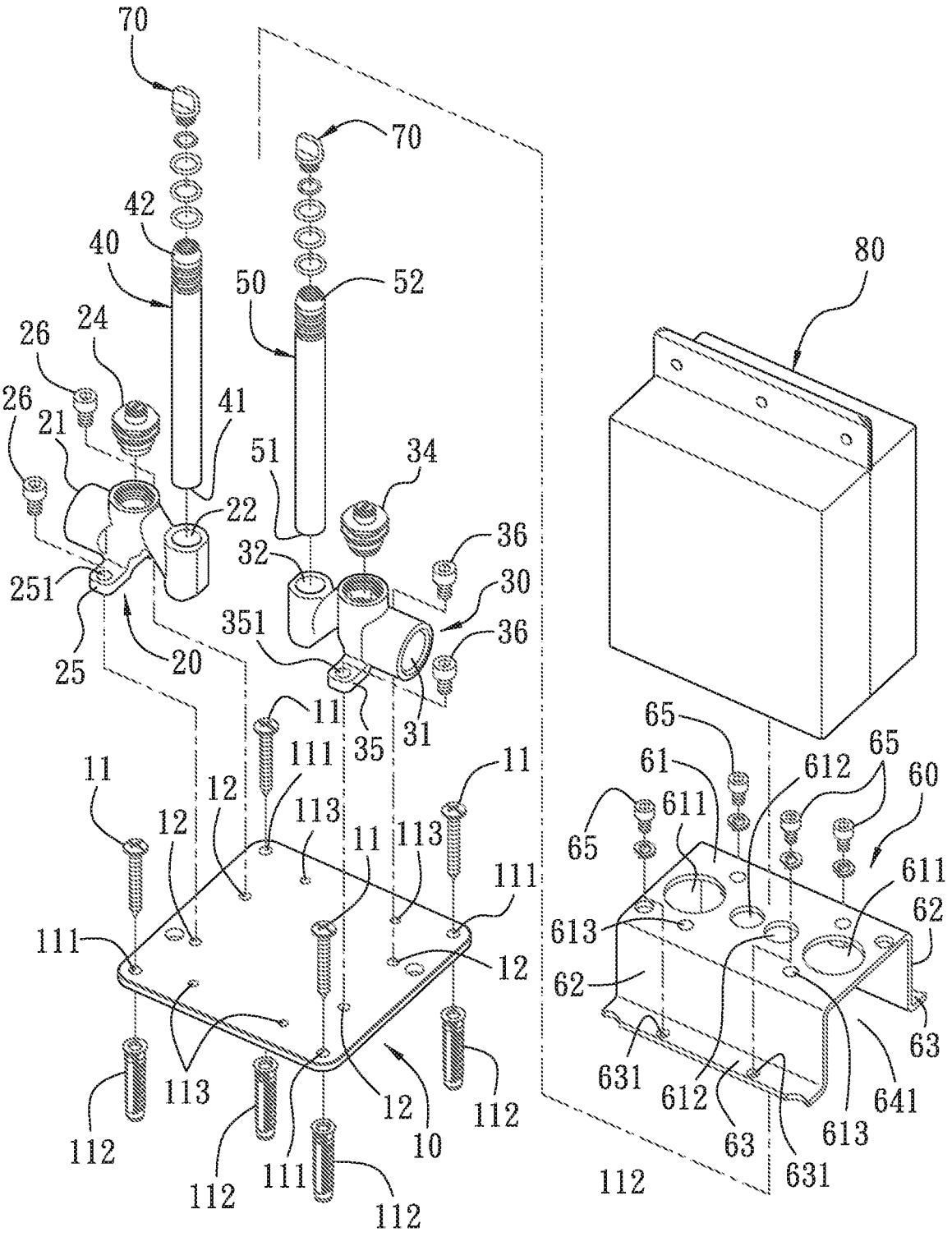
FIG. 2 is an explosive view of the embodiment in FIG. 1 according to the present invention.
Figure 5:
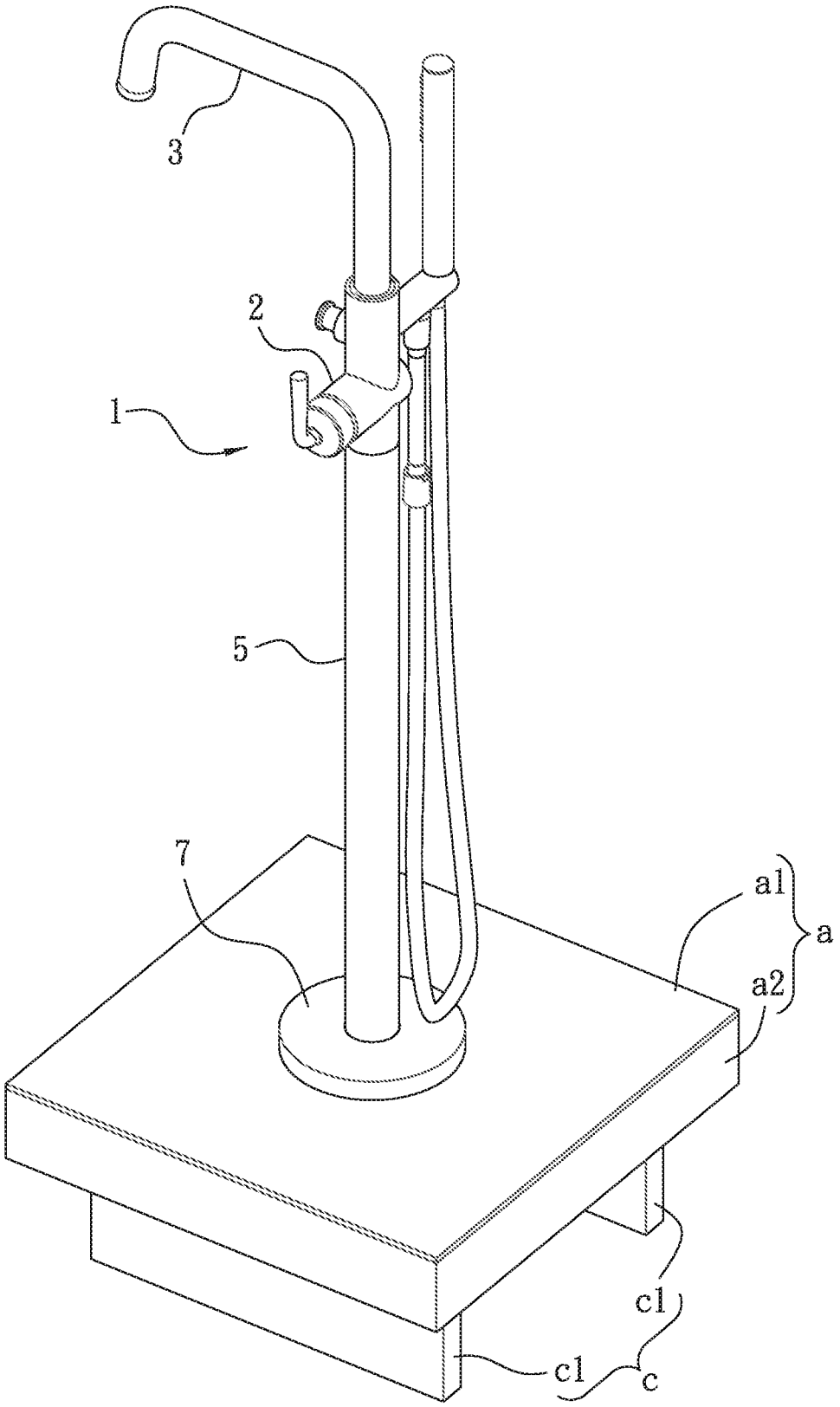
FIG. 5 is a perspective view of a free-standing faucet mounted on a floor by an embodiment according to the present invention.
Figure 6:
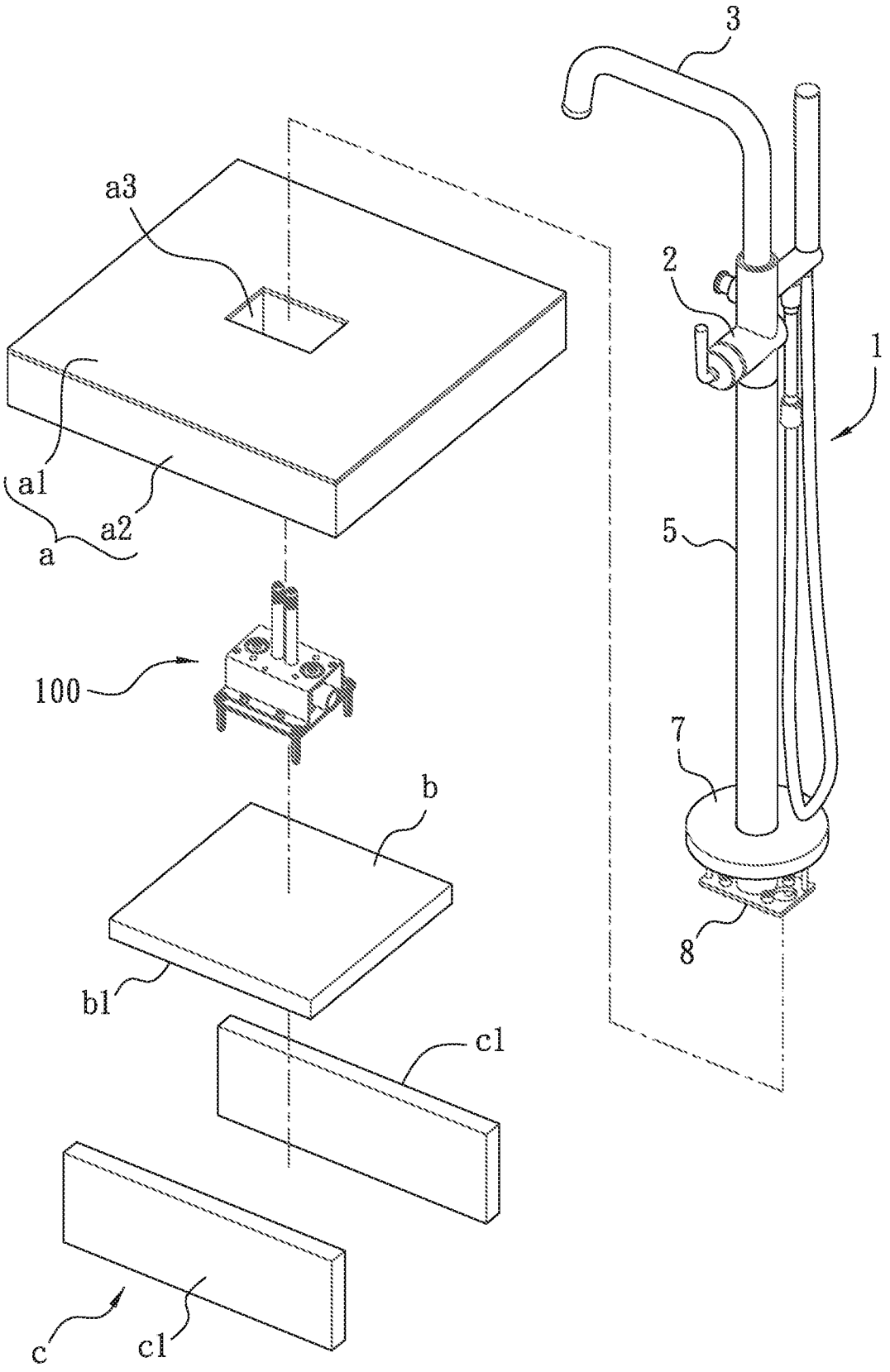
FIG. 6 is an explosive view of FIG. 5.

Refer to FIG. 2, FIG. 5 and FIG. 6, the base 10 is connected to a connecting wall b under the floor a. In this embodiment, the base 10 is fastened on the connecting wall b by a plurality of fasteners 11 inserted through the base 10. For easy and quick assembly, a plurality of insertion holes 111 are formed on the base 10 in advance while a self-tapping screw is used as the fastener 11 and used in combination with a plastic expansion tube 112. After being passed through the insertion hole 111, the self-tapping screw is connected to and locked in the plastic expansion tube 112 mounted in the connecting wall b.

It should be noted that the above connecting wall b is formed by a support board b1 which is fixed on a basic object c. The basic object c includes two vertical plates c1 while two ends of the support board b1 are fixed on surfaces of the vertical plates c1 opposite to each other. The vertical plates c1 are disposed on a floor surface and the bottom surface of the pad a2 of the floor a is supported by the top surfaces of the vertical plates c1, as show in FIG. 6 and FIG. 9. The floor surface can be a concrete surface or others. The vertical plate c1 can be a wood panel produced at the job site and there is generally a plurality of vertical plates c1 spaced evenly and used for supporting the floor a. In this embodiment, there are two vertical plates c1 used as the basic object c for mounting the support board b1 which is usually prepared by the workers at the site. Thus both the support board b1 and the basic object c are not a part of the present rough-in assembly 100. The basic object c is not limited to the mode of the vertical plates c1 mentioned above.

Figure 3:
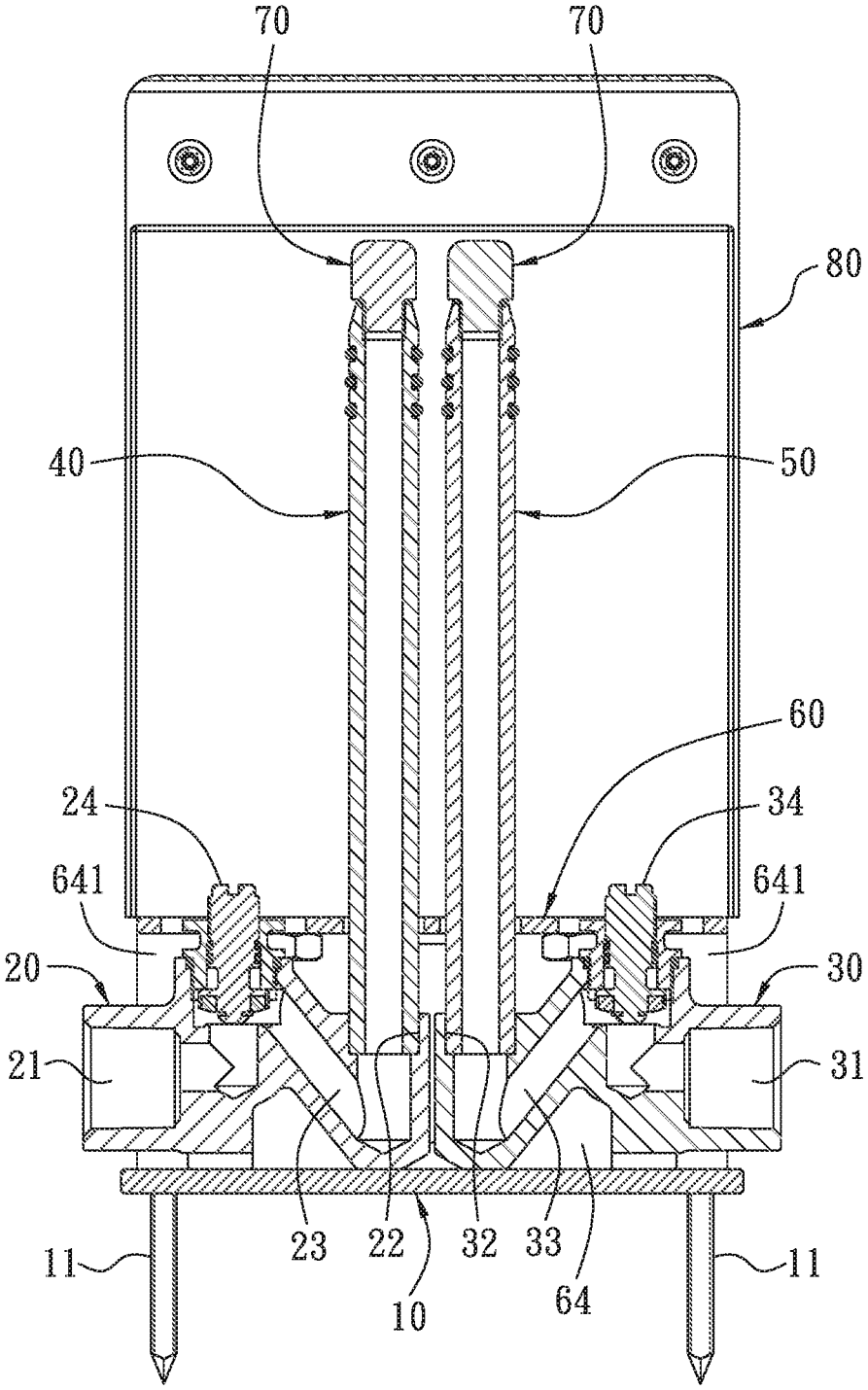
FIG. 3 is a side view of a longitudinal section of the embodiment in FIG. 1 taken along a first water inlet of a first water-contact member and a second water inlet of a second water-contact member according to the present invention.

Refer to FIG. 2, FIG. 3 and FIG. 8, the first water-contact member 20 which is connected to a top surface of the base 10 is composed of a first water inlet 21, a first water outlet 22, a first water passage 23 formed between the first water inlet 21 and the first water outlet 22, and a first control valve set 24 disposed on the first water passage 23 for control of a water flow passed through the first water passage 23. A first water supply pipe d1 is connected to the first water inlet 21 for supplying either cold water or hot water to the first water-contact member 20.

As shown in FIG. 2, FIG. 3 and FIG. 8, the second water-contact member 30 which is connected to the top surface of the base 10 consists of a second water inlet 31, a second water outlet 32, a second water passage 33 formed between the second water inlet 31 and the second water outlet 32, and a second control valve set 34 disposed on the second water passage 33 for control of a water flow passed through the second water passage 33. A second water supply pipe d2 is connected to the second water inlet 31 for supplying either cold water or hot water to the second water-contact member 30. The first water supply pipe d1 and the second water supply pipe d2 come in pairs. One of them d1, d2 supplies hot water while the other supplies cold water.

Refer to FIG. 2 and FIG. 8, the first connection pipe 40 has a first inlet end 41, and a first outlet end 42. The first inlet end 41 is connected to the first water outlet 22 of the first water-contact member 20 for guiding a water flow from the first water-contact member 20 to the first flow pipe 4*a* of the free-standing faucet 1 through the first outlet end 42.

The second connection pipe 50 has a second inlet end 51, and a second outlet end 52. The second inlet end 51 is connected to the second water outlet 32 of the second water-contact member 30 for guiding a water flow from the second water-contact member 30 to the second flow pipe 4*b* of the free-standing faucet 1 through the second outlet end 52.

The sleeve mounting seat 60 is connected to the top surface of the base 10 and a top plate portion 61 which is extending across the first water-contact member 20 and second water-contact member 30 is disposed on the sleeve mounting seat 60. Two first hollow-out holes 611 are arranged at the top plate portion 61 and corresponding to the first control valve set 24 and the second control valve set 34 respectively. The top plate portion 61 further includes two second hollow-out holes 612 through which the first connection pipe 40 and the second connection pipe 50 are passed respectively.

In this embodiment, the first connection pipe 40 and the second connection pipe 50 are provided. In some other embodiments, the first flow pipe 4*a* and the second flow pipe 4*b* of the free-standing faucet 1 are passed through the two second hollow-out holes 612 and connected to the first water outlet 22 of the first water-contact member 20 and the second water outlet 32 of the second water-contact member 30 respectively. Thus the first connection pipe 40 and the second connection pipe 50 are no more required and the rough-in assembly 100 has a simpler structure.

Refer to FIG. 6, in this embodiment, a vertical mounting hole a3 through the floor a is provided while at least the top plate portion 61 of the sleeve mounting seat 60 is extending up above the bottom of the mounting hole a3 and mounted in the mounting hole a3. At the same time, the first connection pipe 40 and the second connection pipe 50 are also protruding from and passed through the mounting hole a3 and an opening on the bottom of the free-standing sleeve 5 to be mounted into the chamber 5*a* of the free-standing sleeve 5.

Figure 7:
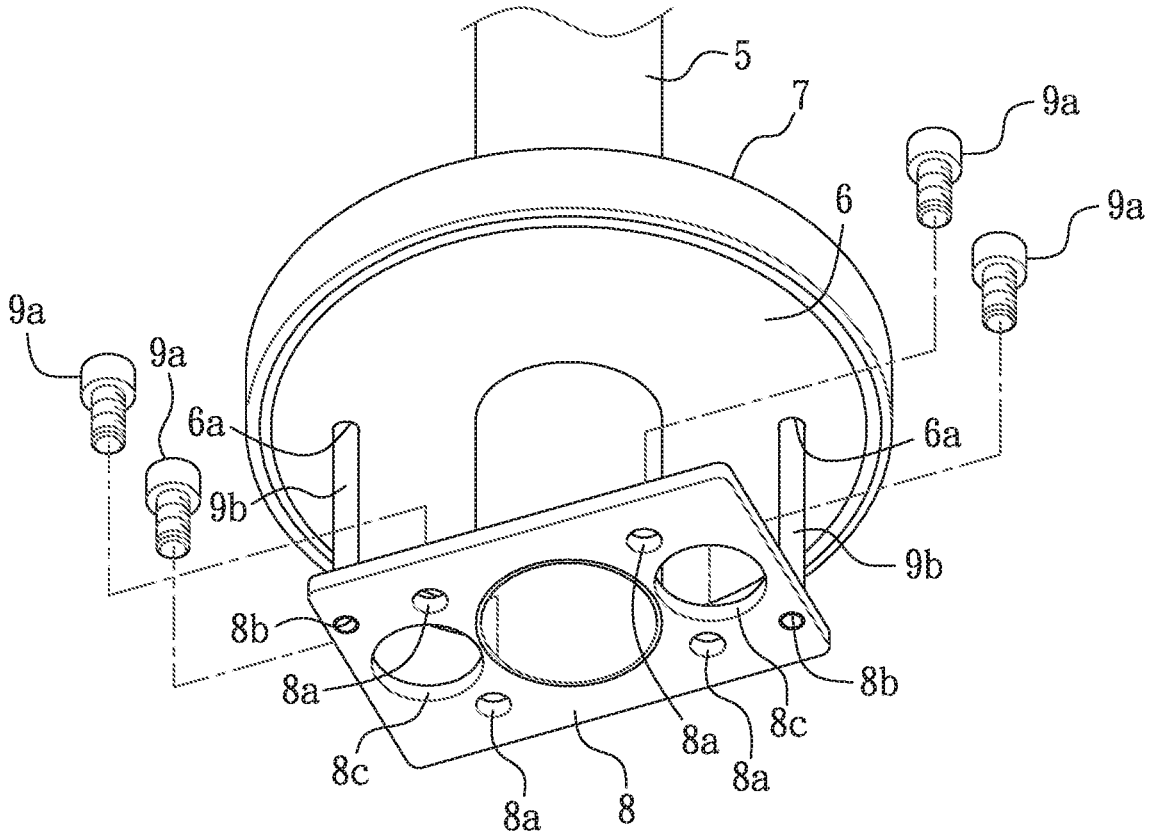
FIG. 7 is a partial explosive view of a bottom of a free-standing faucet.

Refer to FIG. 2 and FIG. 7, a plurality of first threaded holes 613 are disposed on the top plate portion 61 of the sleeve mounting seat 60. The free-standing faucet 1 further includes a sealing plate 6, a decorative cover 7, a fixing baseplate 8, a plurality of first bolts 9*a* and two second bolts 9*b*. The sealing plate 6 and the decorative cover 7 are slidably mounted to an outer peripheral wall of the free-standing sleeve 5 and used for sealing the mounting hole a3 of the floor a and covering the sealing plate 6 respectively. The fixing baseplate 8 is connected to and fixed on an outer peripheral wall of the bottom of the free-standing sleeve 5 and provided with a plurality of first insertion holes 8*a*, two second threaded holes 8*b* and two valve-set holes 8*c*. Two second insertion holes 6*a* are formed on the sealing plate 6. By the respective first bolts 9*a* being inserted through the respective first insertion holes 8*a* of the fixing baseplate 8 and threaded into the respective first threaded holes 613 on the top plate portion 61 correspondingly, the fixing baseplate 8 is connected to the top plate portion 61 of the sleeve mounting seat 60, as shown in FIG. 2, FIG. 6 and FIG. 7. Refer to FIG. 7 and FIG. 8, the sealing plate 6 is abutting against and sealing the top surface of the floor a by the respective second bolts 9*b* being inserted through the respective second insertion holes 6*a* of the sealing plate 6 and screwed into the respective second threaded holes 8*b* of the fixing baseplate 8.

It should be noted that the above sealing plate 6 is only used as a cover and the requirement for sealing effect is not much. Thereby the sealing plate 6 is only need to be abutting against and attached to the floor a slightly in order to ensure that the top surface of the floor a has no damages or deformation.

It should be understood that the sealing plate 6 is not necessary for the free-standing faucet 1 and the decorative cover 7 is directly covering the mounting hole a3 of the floor a. The difference between the free-standing faucets 1 with and without the sealing plate 6 is in that the free-standing faucets 1 with the sealing plate 6 has better stability and sealing effect compared with the free-standing faucet 1 without the decorative cover 7. Yet the decorative cover 7 is only slidably mounted to outer peripheral wall of the free-standing sleeve 5, without being fastened on any component so that the decorative cover 7 applies nearly no clamping force to the top surface of the floor a and the original appearance of the floor is maintained. Moreover, the second bolts 9*b* and the second threaded holes 8*b* are no more required under the condition that the sealing plate 6 is not provided.

Figure 4:
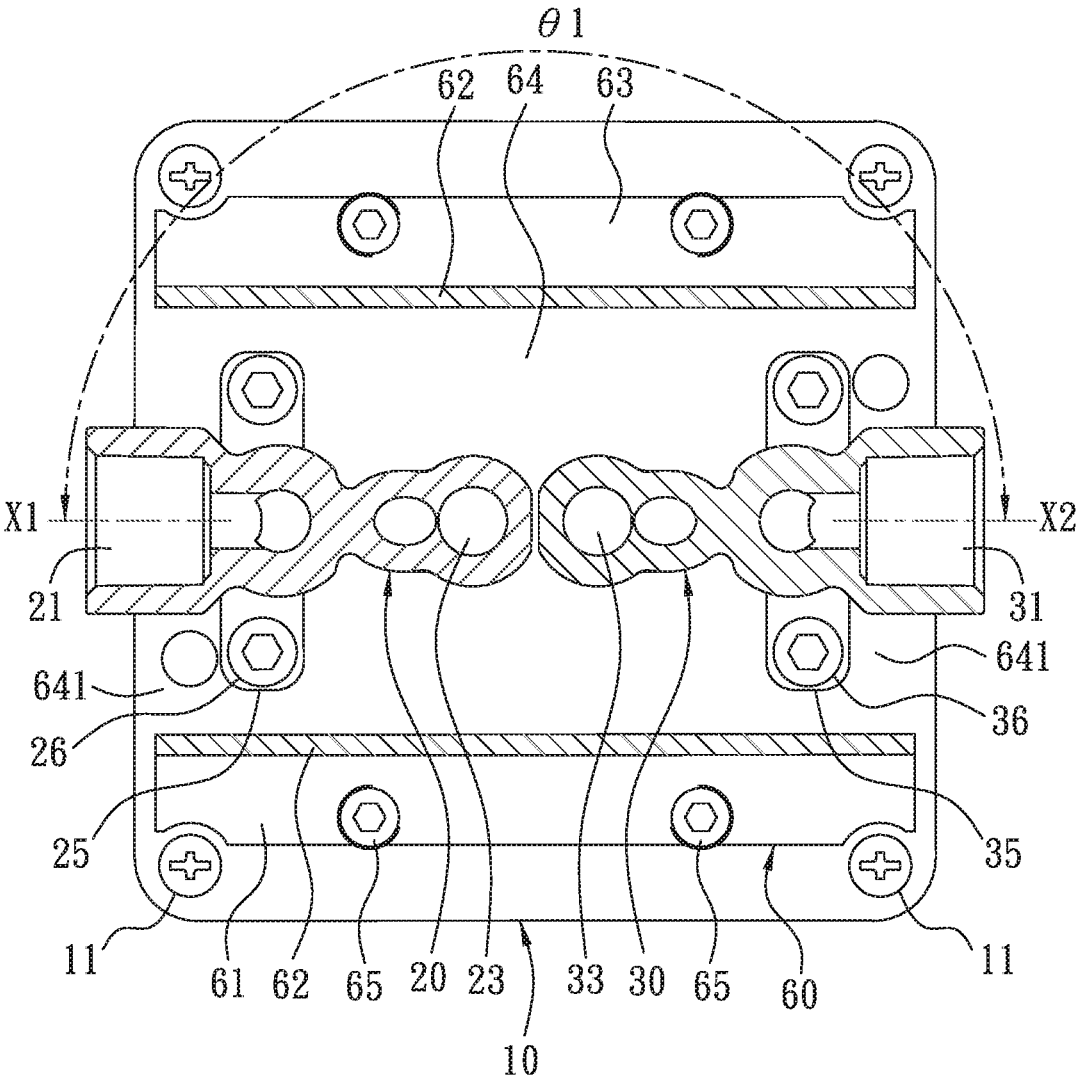
FIG. 4 is a side view of a cross section of the embodiment in FIG. 1 taken along a first water inlet of a first water-contact member and a second water inlet of a second water-contact member according to the present invention.

In this embodiment, there is an angle θ1 formed between the first central axis X1 in the opening direction of the first water inlet 21 of the first water-contact member 20 and the second central axis X2 in the opening direction of the second water inlet 31 of the second water-contact member 30. The angle θ1 is 180 degrees, as shown in FIG. 4.

In this embodiment, the sleeve mounting seat 60 is C-shaped, as shown in FIG. 2. Besides the top plate portion 61, the sleeve mounting seat 60 further includes two side plate portions 62 integrally extending from two opposites sides of the top plate portion 61, two connecting plate portions 63 integrally extending from the respective side plate portions 62 and used for connection with the top surface of the base 10, and a mounting space 64 defined by the top plate portion 61 and the side plate portions 62. An opening 641 is formed on each of two opposite sides of the mounting space 64, as shown in FIG. 3 and FIG. 4. Thus the first water supply pipe d1 is connected to the first water inlet 21 of the first water-contact member 20 through one of the openings 641 and the second water supply pipe d2 is connected to the second water inlet 31 of the second water-contact member 30 through the other opening 641.

Refer to FIG. 2, in this embodiment, the respective connecting plate portions 63 of the sleeve mounting seat 60 are connected to and fastened on the base 10 by two fasteners 65. For easy and quick assembly, two insertion holes 631 and four threaded holes 113 are formed on each of the connecting plate portions 63 and the base 10 respectively in advance. And a plurality of bolts are used as the fasteners 65 which are passed through the insertion holes 631 and then threaded into and secured in the respective threaded holes 113 correspondingly.

Still refer to FIG. 2, in this embodiment, the first water-contact member 20 and the second water-contact member 30 include two first lugs 25 and two second lugs 35 respectively. Each of the first lugs 25 and each of the second lugs 35 are provided with a first insertion hole 251 and a second insertion hole 351 respectively. The base 10 is arranged with four connecting holes 12 which are divided into two sets. By two sets of two fasteners 26, 36 inserted through the first insertion holes 251 on the first lugs 25 and the second insertion holes 351 on the second lugs 35 and secured in the respective sets of the connecting holes 12 respectively, the first water-contact member 20 and the second water-contact member 30 are connected to and fixed on the base 10. The fasteners 26, 36 can be common bolts and the connecting holes 12 are threaded holes.

In this embodiment, the rough-in assembly 100 further includes two air caps 70 used for being plugged into the first outlet end 42 of the first connection pipe 40 and the second outlet end 52 of the second connection pipe 50 correspondingly for sealing.

Figure 9:
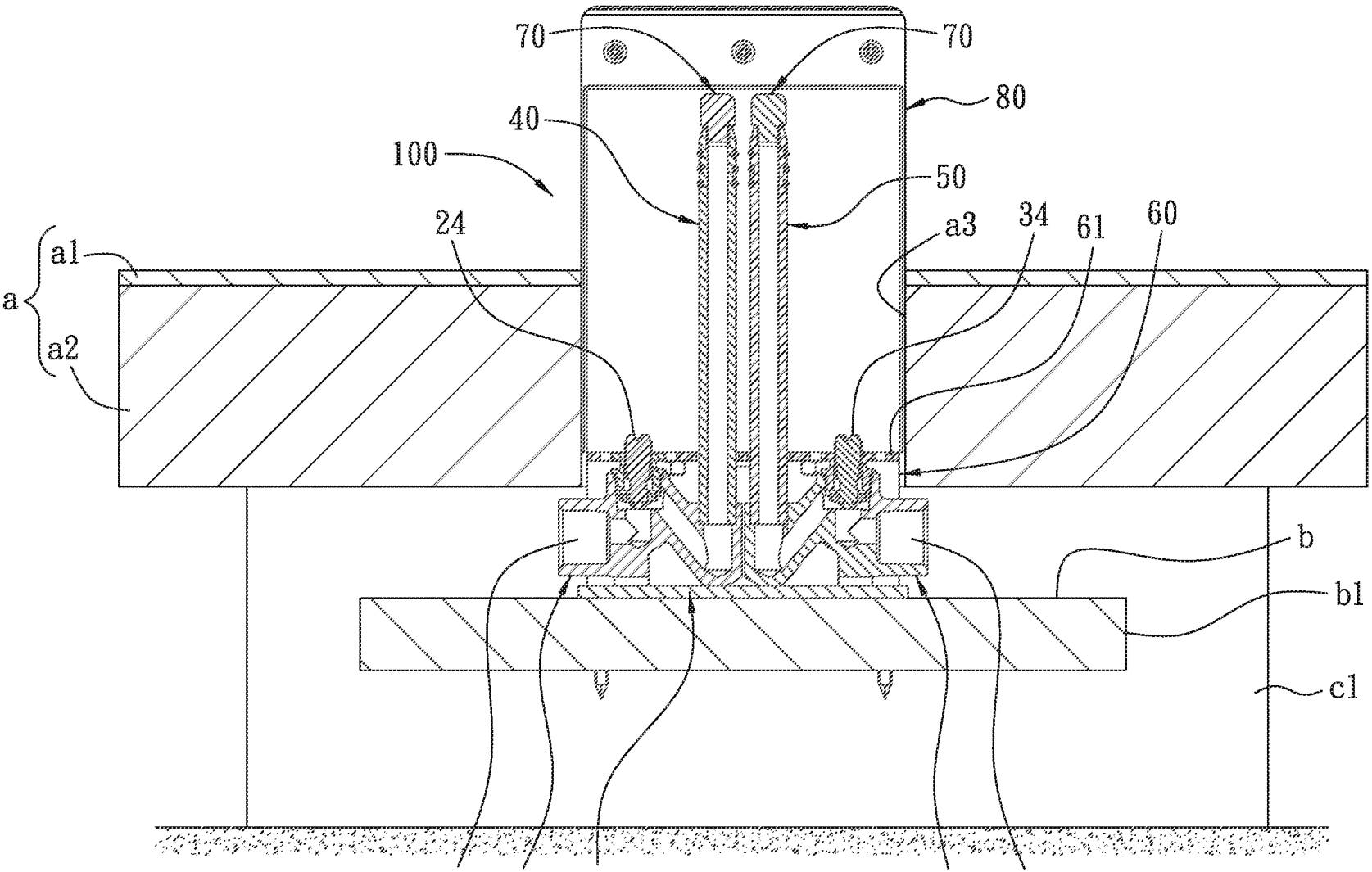
FIG. 9 is a schematic drawing showing an embodiment being installed on the floor, a support board, and a basic object according to the present invention.

As shown in FIG. 9, in this embodiment, the rough-in assembly 100 further includes a protective cover 80 whose bottom is well mounted in the mounting hole a3 of the floor a so as to cover and protect the first connection pipe 40, the second connection pipe 50, the first control valve set 24 of the first water-contact member 20 and the second control valve set 34 of the second water-contact member 30 arranged relative to the mounting hole a3. The arrangement of the protective cover 80 is the same as the conventional one, mainly used to prevent dust and other foreign matter generated during installation from entering the rough-in assembly 100 through the respective pipes, holes or gaps and further avoid the effects of the dust and other foreign matter on normal operation of the rough-in assembly 100. It should be noted that the protective cover 80 is mounted to and fixed on an inner wall of the mounting hole a3 by tight fit, instead of being fastened on one of the components. Or the protective cover 80 is directly abutting against and supported by certain positions of the first water-contact member 20 and the second water-contact member 30. Thereby the protective cover 80 can be detached and removed quickly after the installation of the rough-in assembly 100 being completed, without using any removal tools.

The installation of the rough-in assembly 100 of the present invention has the following steps.

First, the base 10, the first water-contact member 20, the second water-contact member 30, the first connection pipe 40, the second connection pipe 50, and the sleeve mounting seat 60 are assembled with one another. The assembly process can be done either at the site or before packaging of the product.

Then the base 10 is fastened on the support board b1 of the connecting wall b prepared in advance. Meanwhile, the first water supply pipe d1 is connected to the first water-contact member 20 and the second water supply pipe d2 is connected to the second water-contact member 30. Later perform water testing and air testing of the respective pipelines of the rough-in assembly 100 to ensure no leakage.

Next the floor a and the protective cover 80 are placed in turn and other construction work is carried on.

After other construction work being completed, the protective cover 80 and the air cap 70 are removed. The first outlet end 42 of the first connection pipe 40 and the second outlet end 52 of the second connection pipe 50 are mounted and positioned in the first flow pipe 4*a* and the second flow pipe 4*b* of the inlet tube set 4 of the free-standing faucet 1 respectively. Then the fixing baseplate 8 is fastened on the top plate portion 61 of the sleeve mounting seat 60 while the sealing plate 6 is abutting against and pressed on the top surface of the floor a around the mounting hole a3 for covering the mounting hole a3 by the second bolts 9*b* that fasten the sealing plate 6 on the fixing baseplate 8. Later the decorative cover 7 is placed over the sealing plate 6. Thereby the free-standing faucet 1 is installed and fixed on the floor a quickly by the rough-in assembly 100 and the installation of the free-standing faucet 1 is completed.

Figure 10:
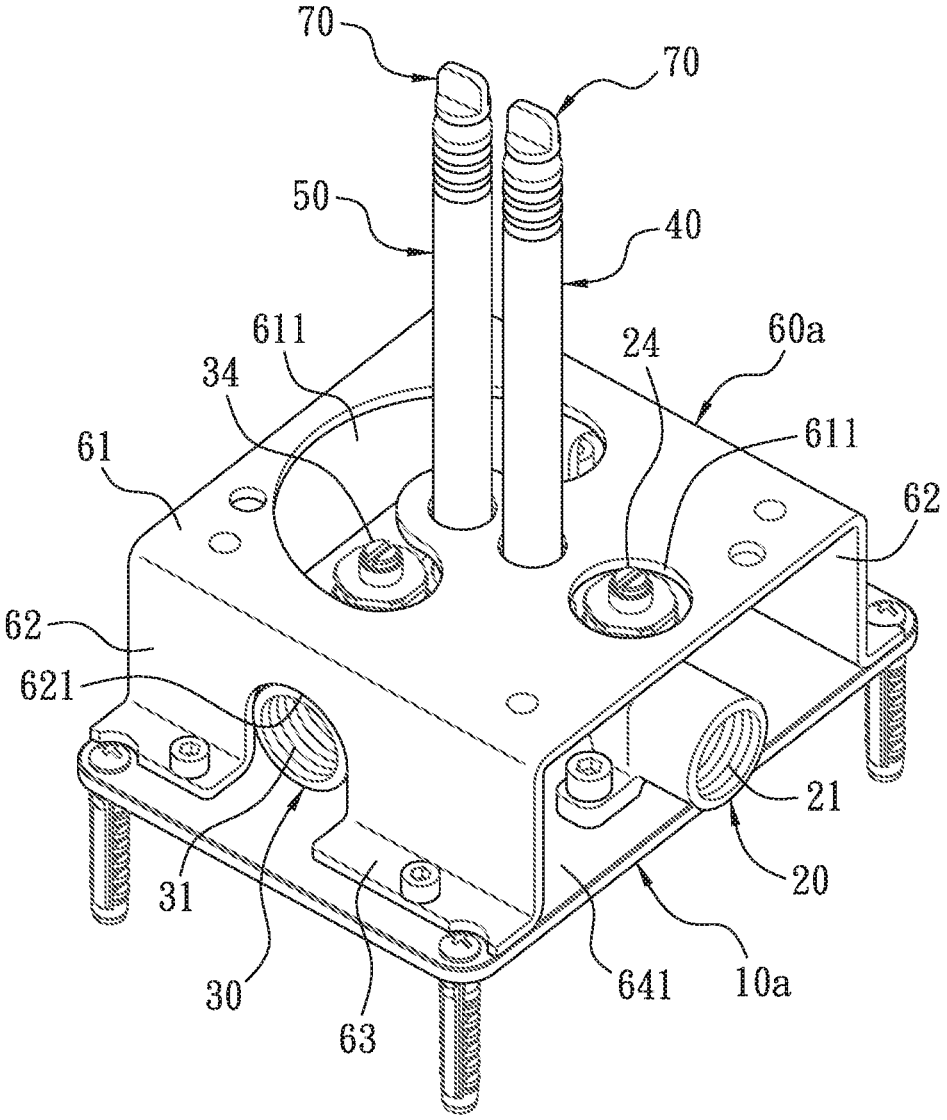
FIG. 10 is a perspective view of another embodiment without a protective cover according to the present invention.
Figure 11:
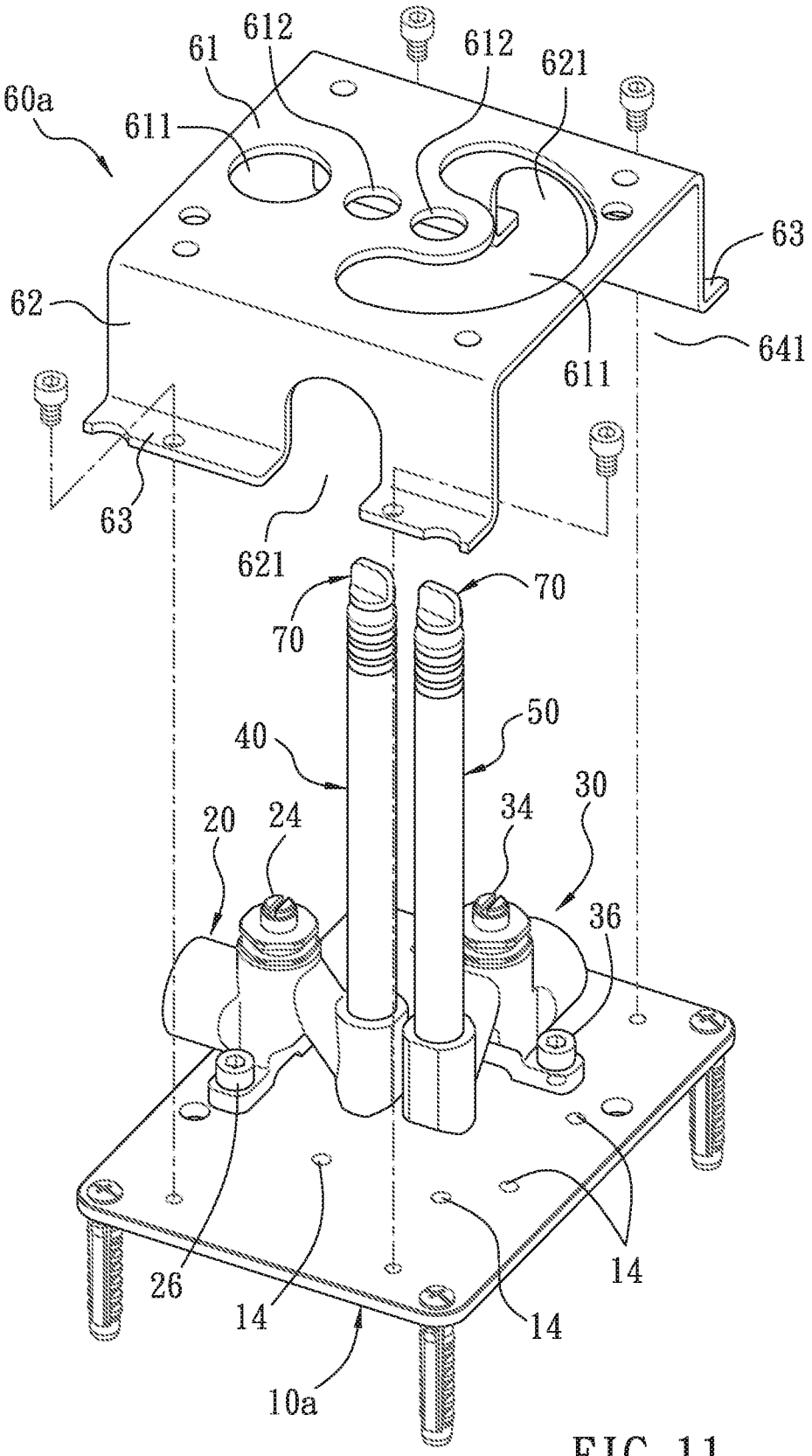
FIG. 11 is a partial explosive view of the embodiment in FIG. 10 according to the present invention.
Figure 12:
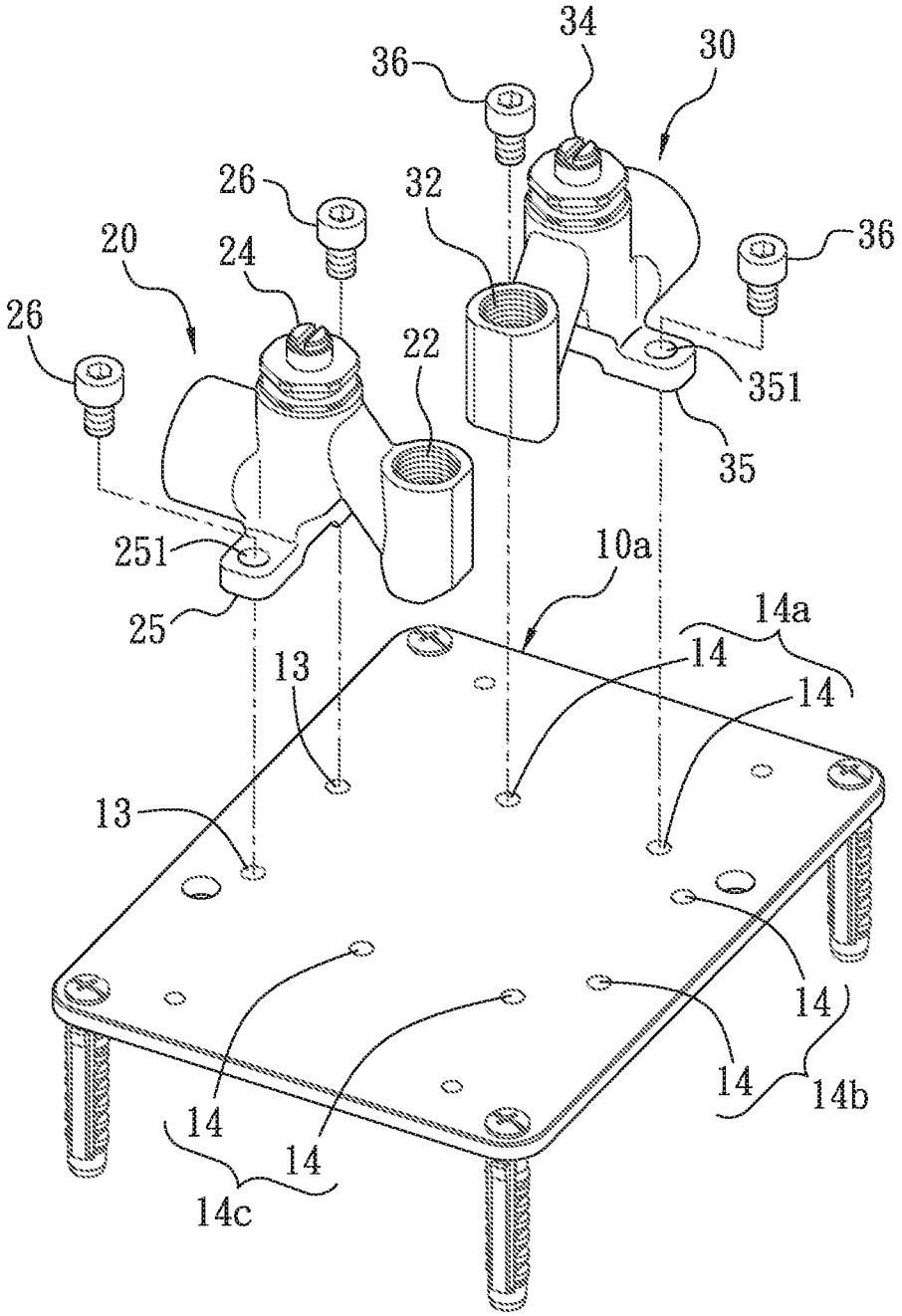
FIG. 12 is an explosive view of a base, a first water-contact member, and a second water-contact member of the embodiment in FIG. 10 according to the present invention.
Figure 13:
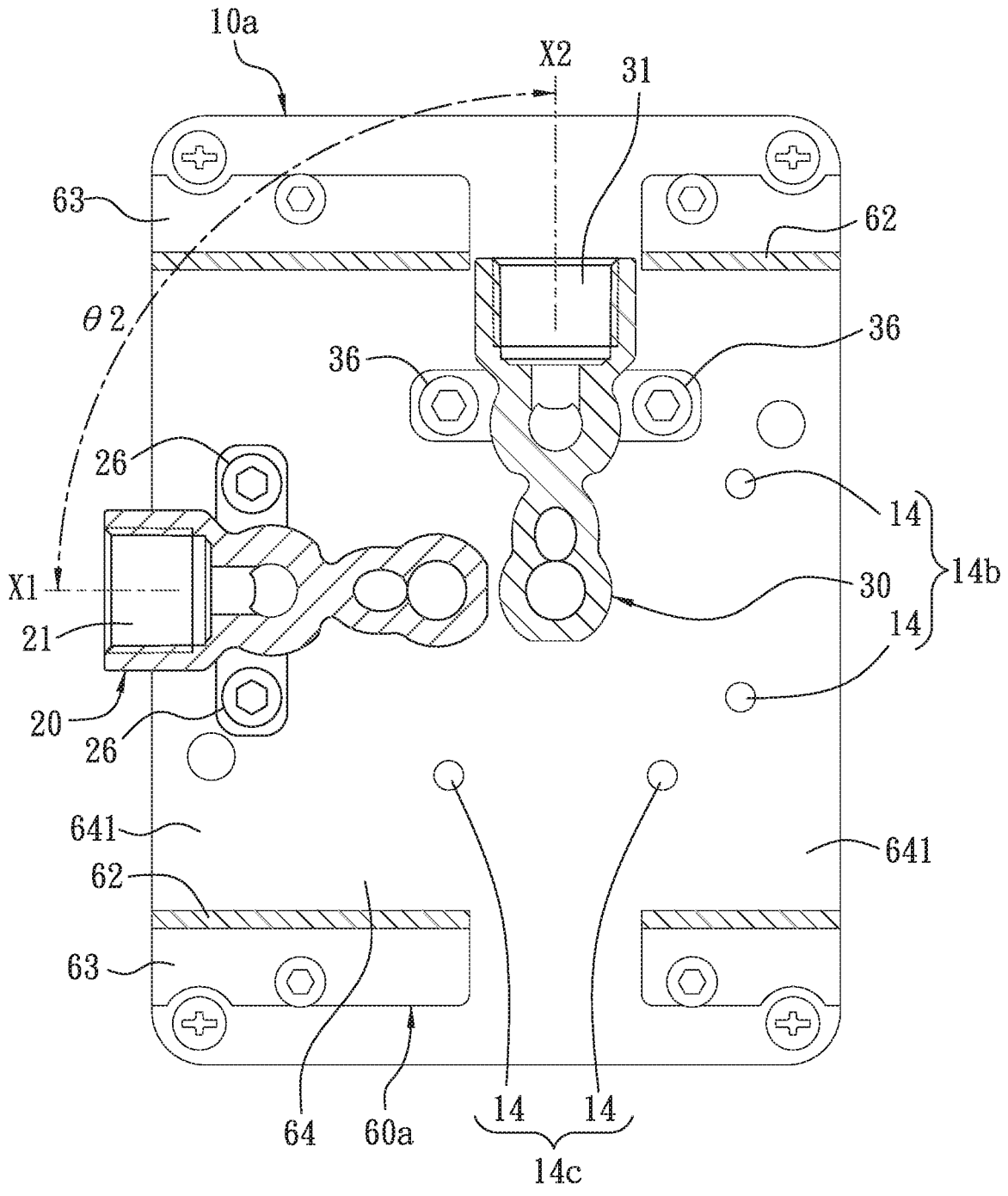
FIG. 13 is a side view of a cross section of the embodiment in FIG. 10 taken along a first water inlet of a first water-contact member and a second water inlet of a second water-contact member according to the present invention.

Refer to FIG. 10, FIG. 11, and FIG. 12, another embodiment is revealed. The difference between this embodiment and the above one is in that an ange1θ2 formed between the first central axis X1 in the opening direction of the first water inlet 21 of the first water-contact member 20 and the second central axis X2 in the opening direction of the second water inlet 31 of the second water-contact member 30 in this embodiment is in the range of 90 degrees to 270 degrees (as shown in FIG. 13) while the angle θ1 of the above embodiment is limited to 180 degrees. In other words, compared with the first embodiment, the angle θ2 of this embodiment is adjustable in the range of 90 degrees to 270 degrees, not limited to 180 degrees. For example, the positions and the directions of both the first water-contact member 20 and the second water-contact member 30 can be adjusted at the same time. Or one of the first and the second water-contact members 20, 30 is fixed while the position and the direction of the other water-contact members 20, 30 are adjustable.

In this embodiment, the first water-contact member 20 whose direction and position are nonadjustable is fixed on the base 10*a* and the second water-contact member 30 whose direction and position are adjustable is connected to the base 10*a* so as to adjust and control the angle θ2. A feasible approach is that the angle θ2 can be 90 degrees, 180 degrees or 270 degrees. To go a step further, generally water supply pipes that supply cold and hot water such as the first water supply pipe d1 and the second water supply pipe d2 have already been arranged before installation of the free-standing faucet 1. Thereby the rough-in assembly 100 can be applied to the water supply pipes commonly arranged perpendicular to or in line with each other when the angle θ2 is 90 degrees, 180 degrees, or 270 degrees as mentioned above.

In this embodiment, as shown in FIG. 12, two first connecting holes 13 and at least six second connecting holes 14 are disposed on the base 10*a*. Two of the second connecting holes 14 form a set so that the second connecting holes 14 are divided into a first set 14*a* of the second connecting holes 14, a second set 14*b* of the second connecting holes 14 and a third set 14*c* of the second connecting holes 14. The first water-contact member 20 is fixed on the base 10*a* by two fasteners 26 being inserted through respective first insertion holes 251 on respective first lugs 25 and secured in the respective first connecting holes 13. The second water-contact member 30 is connected to the base 10*a* by two fasteners 36 being inserted through respective second insertion holes 351 on respective second lugs 35 and selectively locked in one of the three sets 14*a*, 14*b*, and 14*c* of the second connecting holes 14. The angle θ2 is 90 degrees, 180 degrees, and 270 degrees when the fasteners 36 are connected to the first set 14*a* of the second connecting holes 14, the second set 14*b* of the second connecting holes 14 and the third set 14*c* of the second connecting holes 14 respectively.

It should be noted that the centers of the second connecting holes 14 are all located at a circumference of an imaginary circle while the center of the imaginary circle is located at the central axis of the second water outlet 32 of the second water-contact member 30. Thereby the position of the second water outlet 32 remains the same no matter how the second water-contact member 30 is adjusted. The relative position of the first connection pipe 40 to the second connection pipe 50 is further ensured. That means the assembly of the second connection pipe 50 with the second flow pipe 4*b* will not be affected.

It should be understood easily that whether the second water-contact member 30 or the second water supply pipe d2 connected to the second water-contact member 30 can be inserted through the sleeve mounting seat 60*a* smoothly should be considered in order to avoid interference with the second water-contact member 30 when the position and the direction of the second water-contact member 30 are adjustable. Thus a through hole 621 is disposed on each of the side plate portions 62*a* of the sleeve mounting seat 60*a*. Thereby the second water supply pipe d2 is connected to the second water inlet 31 of the second water-contact member 30 through one of the opposite openings 641 or one of the opposite through holes 621. For example, the second water supply pipe d2 is connected to the second water inlet 31 of the second water-contact member 30 through one of the opposite openings 641 while the second water-contact member 30 is disposed on the position where the angle θ2 formed is 180 degrees. The second water supply pipe d2 is connected to the second water inlet 31 of the second water-contact member 30 through one of the opposite through holes 621 when the angle θ2 formed between the first water-contact member 20 and the second water-contact member 30 is 90 degrees or 270 degrees.

It should be noted that the second water inlet 31 of the second water-contact member 30 can be designed to be located at an inner side of the side plate portion 62. At the moment, the second water supply pipe d2 is inserted through the opening 641 or the through hole 621 to be connected to the second water inlet 31. Or the second water inlet 31 can be designed to be protruding from the opening 641 or the through hole 621, located at an outer side of the side plate portion 62. This is beneficial to the assembly of the second water supply pipe d2 with the second water inlet 31.

Moreover, due to limitation caused by the side plate portion 62, the second water inlet 31 or the second water supply pipe d2 may have interference with the corresponding side plate portion 62 while the second water-contact member 30 is arranged at certain positions with specific angle θ2. Thus the present rough-in assembly 100 may be unable to be used at certain specific angles θ2 between 90 degrees and 270 degrees. However, the rough-in assembly 100 can be applied as long as there is no interference. Thereby the rough-in assembly is much more applicable.

Furthermore, one of the first hollow-out holes 611 on the top plate portion 61 of the sleeve mounting seat 60 corresponding to the second control valve set 34 is designed into a curved slot. Thereby the second control valve set 34 is able to be kept within the curved slot or even allowed to be extending out above the curved slot, without affecting operation and control performed by installers during installation when the angle θ2 is adjusted in the range of 90 degrees to 270 degrees.

The installation steps of this embodiment of the rough-in assembly 100 are similar to those of the above embodiment and the only difference between the two embodiments is in that: whether the position and the direction of the second water-contact member 30 being assembled need to be adjusted in advance according to positions and directions of the first water supply pipe d1 and the second water supply pipe d2 is checked firstly. Once it is confirmed that the adjustment is necessary, the installer needs to check whether the sleeve mounting seat 60*a* needs to be detached, depending on the actual conditions. If the sleeve mounting seat 60*a* needs to be detached in advance, put it back after the first water-contact member 20 and the second water-contact member 30 being assembled with the first water supply pipe d1 and the second water supply pipe d2 respectively and the base 10 being fastened on the support board b1.

In summary, the rough-in assembly 100 of the present invention has the following features and functions: firstly the rough-in assembly 100 includes two separate water-contact members, the second water-contact member 20 and the second water-contact member 30. The position and the direction of at least one of the water-contact members are adjustable according to actual arrangement of the water supply pipes. For example, the rough-in assembly 100 can be used for installation of the water supply pipes usually arranged in line with each other (at an angle of 180 degrees), perpendicular to each other (at an angle of 90 or 270 degrees), or with a specific angle therebetween (an angle ranging from 90 to 270 degrees). Thereby the rough-in assembly 100 can be widely adapted for use in different water supply pipe arrangements. Therefore not only the cost for mold making and material preparation is reduced, the ease of installation is also enhanced. Secondly the free-standing faucet 1 can be installed and fixed directly by the arrangement of the sleeve mounting seat 60. Compared with the conventional technique by which the free-standing faucet 1 is directly clamped and fastened on the floor, the problem of the floor that is easy to have dents or deformation can be solved. There are no worries about either damages to the floor caused by the dents and deformation or whether the structural strength of the floor made of specific material and thickness is able to bear the clamping force or the total weight of the free-standing faucet 1 and the rough-in assembly 100. Thereby free-standing faucet 1 is securely firmly, without being wobbly while being touched or contacted. The dent and deformation problems of the floor a can be avoided to improve the aesthetic appearance.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A rough-in assembly for free-standing faucets having at least a part thereof being fixed under a floor comprising:

a base connected under the floor;

a first water-contact member which is connected to a top surface of the base and composed of a first water inlet, a first water outlet, a first water passage formed between the first water inlet and the first water outlet, and a first control valve set disposed on the first water passage for control of a water flow passed through the first water passage;

a second water-contact member which is connected to the top surface of the base and composed of a second water inlet, a second water outlet, a second water passage formed between the second water inlet and the second water outlet, and a second control valve set disposed on the second water passage for control of a water flow passed through the second water passage; and a sleeve mounting seat connected to the top surface of the base and having a top plate portion which is extending across the first water-contact member and second water-contact member and provided with two first hollow-out holes corresponding to the first control valve set and the second control valve set respectively.

2. The device as claimed in claim 1, wherein the base is fastened on a connecting wall by a plurality of fasteners inserted through the base.

3. The device as claimed in claim 2, wherein the connecting wall is formed by a support board and the support board is fixed on a basic object.

4. The device as claimed in claim 3, wherein the basic object includes two vertical plates, both of which are disposed on a floor surface, and two ends of the support board are fixed on opposite surfaces of the vertical plates correspondingly.

5. The device as claimed in claim 4, wherein the floor includes a surface plate and a pad connected to a bottom surface of the surface plate while a bottom surface of the pad is supported by top surfaces of the vertical plates.

6. The device as claimed in claim 1, wherein the rough-in assembly further includes:

a first connection pipe which includes a first outlet end and a first inlet end connected to the first water outlet of the first water-contact member for guiding a water flow from the first water-contact member to a first flow pipe of the free-standing faucet through the first outlet end; and a second connection pipe which includes a second outlet end and a second inlet end connected to the second water outlet of the second water-contact member for guiding a water flow from the second water-contact member to a second flow pipe of the free-standing faucet through the second outlet end.

7. The device as claimed in claim 6, wherein the top plate portion of the sleeve mounting seat is further provided with two second hollow-out holes through which the first connection pipe and the second connection pipe are passed respectively.

8. The device as claimed in claim 6, wherein a vertical mounting hole through the floor is provided and at least the top plate portion of the sleeve mounting seat is mounted in the mounting hole while the first connection pipe and the second connection pipe are passed through and protruding from the mounting hole.

9. The device as claimed in claim 8, wherein a plurality of threaded holes are disposed on the top plate portion of the sleeve mounting seat; the free-standing faucet includes a free-standing sleeve, a decorative cover, a fixing baseplate, and a plurality of first bolts; a chamber is formed in the free-standing sleeve for mounting the first flow pipe and the second flow pipe therein while the first connection pipe and the second connection pipe are passed through an opening on the bottom of the free-standing sleeve and mounted into the chamber; the decorative cover is slidably mounted to an outer peripheral wall of the free-standing sleeve for covering the mounting hole of the floor while the fixing baseplate is connected to and fixed on an outer peripheral wall of the bottom of the free-standing sleeve and provided with a plurality of first insertion holes and two valve-set holes; the fixing baseplate is connected to the top plate portion of the sleeve mounting seat by the first bolts being inserted through the first insertion holes and threaded into the first threaded holes.

10. The device as claimed in claim 9, wherein the free-standing faucet further includes a sealing plate and two second bolts; the sealing plate is slidably mounted to the outer peripheral wall of the free-standing sleeve for covering the mounting hole of the floor; the sealing plate is covered with the decorative cover and provided with two second insertion holes while the fixing baseplate is provided with two second threaded holes; the sealing plate is abutting against and sealing the top surface of the floor by the second bolts being inserted through the second insertion holes and threaded into the second threaded holes.

11. The device as claimed in claim 8, wherein the rough-in assembly further includes a protective cover whose bottom is well mounted in the mounting hole of the floor so that the first connection pipe, the second connection pipe, the first control valve set of the first water-contact member and the second control valve set of the second water-contact member arranged relative to the mounting hole are covered with and protected by the protective cover.

12. The device as claimed in claim 6, wherein the rough-in assembly further includes two air caps used for being plugged into the first outlet end of the first connection pipe and the second outlet end of the second connection pipe respectively.

13. The device as claimed in claim 1, wherein an angle is formed between the first central axis in the opening direction of the first water inlet of the first water-contact member and the second central axis in the opening direction of the second water inlet of the second water-contact member; the angle is 180 degrees.

14. The device as claimed in claim 13, wherein the sleeve mounting seat is C-shaped and having two side plate portions integrally extended from two opposites sides of the top plate portion and two connecting plate portions integrally extended from the respective side plate portions and used for connection with the top surface of the base; a mounting space is defined by the top plate portion and the side plate portions; an opening is formed on each of two opposite sides of the mounting space so that the first water supply pipe is connected to the first water inlet of the first water-contact member through one of the openings and the second water supply pipe is connected to the second water inlet of the second water-contact member through the other opening.

15. The device as claimed in claim 14, wherein the connecting plate portion of the sleeve mounting seat is connected to and fastened on the base by at least one fastener.

16. The device as claimed in claim 1, wherein the first water-contact member and the second water-contact member include two first lugs and two second lugs respectively; each of the first lugs and each of the second lugs are provided with a first insertion hole and a second insertion hole respectively; the base is provided with four connecting holes which are divided into two sets; the first water-contact member and the second water-contact member are connected to and fixed on the base by two sets of two fasteners being inserted through the first insertion holes on the first lugs and the second insertion holes on the second lugs and fastened in the two sets of the connecting holes respectively.

17. The device as claimed in claim 1, wherein an angle is formed between the first central axis in the opening direction of the first water inlet of the first water-contact member and the second central axis in the opening direction of the second water inlet of the second water-contact member; the angle is in the range of 90 degrees to 270 degrees.

18. The device as claimed in claim 17, wherein the first water-contact member is fixed on the base and both direction and position of the first water-contact member are unable to be adjusted while the second water-contact member whose direction and position are able to be adjusted is connected to the base so as to adjust and control the angle.

19. The device as claimed in claim 18, wherein the angle is selected from the group consisting of 90 degrees, 180 degrees, and 270 degrees.

20. The device as claimed in claim 19, wherein the first water-contact member and the second water-contact member include two first lugs and two second lugs respectively; each of the first lugs and each of the second lugs are provided with a first insertion hole and a second insertion hole respectively; the base is provided with two first connecting holes and at least six second connecting holes while two of the second connecting holes form a set so that the second connecting holes are divided into a first set, a second set, and a third set; the first water-contact member is fixed on the base by two fasteners inserted through the first insertion holes on the first lugs and locked in the first connecting holes; the second water-contact member is connected to the base by two fasteners inserted through the second insertion holes on the second lugs and selectively fastened in one of the three sets of the second connecting holes; the angle is 90 degrees, 180 degrees, and 270 degrees when the fasteners are connected to the first set, the second set and the third set of the second connecting holes respectively.

21. The device as claimed in claim 20, wherein the sleeve mounting seat is C-shaped and having two side plate portions integrally extended from two opposites sides of the top plate portion and two connecting plate portions integrally extended from the respective side plate portions and used for connection with the top surface of the base; a through hole is disposed on each of the side plate portions of the sleeve mounting seat; a mounting space is defined by the top plate portion and the side plate portions while an opening is formed on each of two opposite sides of the mounting space so that the first water supply pipe is connected to the first water inlet of the first water-contact member through one of the openings and the second water supply pipe is connected to the second water inlet of the second water-contact member through the other opening and one of the through holes; a first hollow-out hole on the top plate portion of the sleeve mounting seat and corresponding to the second control valve set is a curved slot so that the second control valve set is able to be kept within the curved slot when the angle is adjusted in the range of 90 degrees to 270 degrees.

22. The device as claimed in claim 20, wherein the centers of the second connecting holes are arranged at a circumference of an imaginary circle while the center of the imaginary circle is located at the central axis of the second water outlet of the second water-contact member.

* * * * *